US010864575B2

(12) United States Patent
Ahrens et al.

(10) Patent No.: US 10,864,575 B2
(45) Date of Patent: Dec. 15, 2020

(54) RADIALLY ACTING AFTERCOOLER FOR HORIZONTAL CONTINUOUS CASTING

(71) Applicants: Max Ahrens, Indio, CA (US); Rodger W. Spriggs, Fullerton, CA (US)

(72) Inventors: Max Ahrens, Indio, CA (US); Rodger W. Spriggs, Fullerton, CA (US)

( * ) Notice: Subject to any disclaimer, the term of this patent is extended or adjusted under 35 U.S.C. 154(b) by 0 days.

(21) Appl. No.: 16/285,156

(22) Filed: Feb. 25, 2019

(65) Prior Publication Data

US 2020/0269310 A1 Aug. 27, 2020

(51) Int. Cl.
*B22D 11/124* (2006.01)
*B22D 11/045* (2006.01)

(52) U.S. Cl.
CPC ..... *B22D 11/124* (2013.01); *B22D 11/045* (2013.01)

(58) Field of Classification Search
CPC ..... B22D 11/124; B22D 11/045
See application file for complete search history.

(56) References Cited

U.S. PATENT DOCUMENTS 4,580,614 A * 4/1986 Haissig ..... B22D 11/225 164/154.5

* cited by examiner

*Primary Examiner* — Kevin P Kerns
*Assistant Examiner* — Stevens S Ha
(74) *Attorney, Agent, or Firm* — Roy A. Ekstrand

(57) ABSTRACT

An aftercooler for horizontal continuous casting includes a plurality of aftercooler segments each of which includes a plurality of radially acting aftercooler sections. The radially acting sections each define inner surfaces which combine with the remaining radially acting aftercooler sections to form an aftercooler passage. The radially acting sections within each aftercooler segment are banded together by a plurality of resilient encircling bands. The bands draw the radially acting aftercooler sections together to constrain a casting within the casting passage. The plurality of aftercooler segments are provided with a surrounding coolant carrying jacket. A plurality of gas distribution passages are formed in the radially acting aftercooler sections which are provided with a flow of inert gas. The inert gas distributes itself between the surfaces of the casting and the surfaces of the aftercooler passage to prevent oxide formation and to ease the travel of the casting through the aftercooler.

9 Claims, 11 Drawing Sheets

RADIALLY ACTING AFTERCOOLER FOR HORIZONTAL CONTINUOUS CASTING

FIELD OF THE INVENTION

This invention relates generally to horizontal continuous casters and particularly to aftercoolers used therein.

BACKGROUND OF THE INVENTION

Horizontal continuous casters have become extremely pervasive in the metal casting arts enjoying particularly broad use in the casting of relatively thin elongated metal castings such as metal rod or wire. While the design and fabrication of horizontal continuous casters has been subject to substantial variation, generally all may be understood as a combination of the following basic elements. A supply of molten metal, often called a tundish, is positioned in communication with a discharge nozzle. The discharge nozzle is typically formed of a ceramic type material having the capability of withstanding the high temperatures of the molten metal and defining a metal flow passage therethrough. A cooled mold, often formed of copper, or copper alloy, metal is supported in communication with the nozzle and includes a mold passage aligned with the metal flow passage of the nozzle. A water cooling structure surrounds the mold passage. One or more aftercoolers are coupled to the output end of the cooled mold which also typically utilize a water cooled structure. Finally, one or more mechanical pullers are positioned at the output end of the aftercoolers which are operative to withdraw the casting from the aftercoolers in accordance with a predetermined motion profile. The motion profile typically includes a succession of longer forward movements separated by shorter rearward movements. This "back and forth" motion profile creates a succession of weld marks on the outer portion of the casting which are generally known in the art as "witness marks". The resulting casting comprises an elongated wire or rod bearing outer witness marks which is then cut to length or wound for storage.

The design and fabrication of aftercoolers for use in such horizontal continuous casting systems has been subject to substantial variation as practitioners in the art have endeavored to provide improved aftercoolers. The most prevalent of the presently available aftercoolers utilizes an elongated tube having a center passage therethrough which is surrounded by a cooling water jacket. The latter receives a flow of of cooling water intended to carry heat away from the casting as it travels through the aftercooler. The elongated tube is filled with one, or more, graphite sleeves through which the casting emerging from the cooled mold travels. The graphite sleeves act as a lubricant for the sliding casting. Unfortunately, the graphite sleeves are subject to rapid wear and reduce the cooling efficiency of the aftercooler.

The use of graphite lined aftercoolers remains subject to a plurality of significant problems and limitations. The rapid wear of the graphite sleeves, caused by abrasion as the casting travels through the graphite lining, enlarges the sleeve passage. The enlarged graphite sleeve passage results in a lack of contact between the casting and the graphite sleeve surface such that the casting is no longer tightly constrained as it travels through the aftercooler. As a result, the casting becomes crooked. In addition, the reduction of cooling efficiency caused by the graphite sleeves increases the metallurgical length of the casting allowing the formation of shrinkage pockets and voids within the casting. Additional problems arise as the reduced cooling efficiency results in higher casting temperatures as the casting exits the aftercooler. These higher temperatures cause oxide formation which creates an undesired oxide plating on the casting and degrades the witness marks within the casting.

Practitioners in the art have endeavored to compensate for the difficulties created by the use of graphite lined aftercoolers due to the absence of a viable alternative. These compensating activities have proven to be time-consuming and expensive and therefore undesirable. For example, the crooked casting may be straightened in a process generally referred to as "hot stretching" in which the casting is subjected to hydraulic stretch machines and electric resistance heating. Similarly, the creation of excessive voids and shrinkage pockets is sometimes addressed by a process known generally as "hipping" (Hot Isostatic Pressing) in which simultaneous heat and pressure is applied. The problems associated by oxide coating are sometimes addressed by abrasive removal of the oxide coating and degraded witness marks through abrasive metal processes.

The many problems and limitations associated with graphite lined aftercoolers have prompted practitioners in the art to attempt various approaches to otherwise improving aftercoolers. One such approach is set forth in U.S. Pat. No. 4,774,996 issued to Ahrens et al which sets forth a MOVING PLATE CONTINUOUS CASTING AFTERCOOLER in which an aftercooler is comprised of a plurality of generally flat plates are supported by spring supports in overlapping configurations. The overlapping plates define a cooling passage between the plates. Cooling is provided by a water circulation system operative around the overlapping plates.

Despite the many efforts by practitioners in the art to improve aftercoolers there remains a critical unresolved need for improved aftercoolers which overcome the present problems and limitations imposed by graphite lined aftercoolers.

SUMMARY OF THE INVENTION

Accordingly, it is a general object of the present invention to provide an improved aftercooler. It is a more particular object of the present invention to provide an improved aftercooler that avoids the need for lubricating graphite within the aftercooler passage and which increases cooling efficiency and wear resistance. It is a still more particular object of the present invention to provide an improved aftercooler that maintains a straight casting. It is a still more particular object of the present invention to provide an improved aftercooler that produces a casting substantially reduced in the creation of voids and shrinkage pockets. It is a still more particular object of the present invention to provide an improved aftercooler that cools the casting exiting the aftercooler to a reduced temperature thereby avoiding the formation of oxides and degraded witness marks on the casting.

In accordance with the present invention, there is provided an aftercooler having a plurality of aftercooler segments each of which includes a plurality of radially acting sections. The radial acting sections each define inner surfaces which combine with the remaining radially acting sections to form an aftercooler passage. The radially acting sections within each aftercooler segment are joined by a plurality of resilient encircling bands. The bands draw the radially acting sections together to constrain a casting within the aftercooler passage formed by the inner surfaces of the radially acting sections. The plurality of aftercooler segments are provided with a surrounding coolant carrying jacket. A plurality of gas distribution passages are formed in the radially acting sections which are provided with a flow of inert gas. The inert gas distributes itself between the surfaces of the casting and the surfaces of the aftercooler passage to prevent oxide formation and to ease the travel of the casting through the aftercooler.

In further accordance with the present invention there is provided for use in a horizontal continuous casting system in which a cooled die is supplied with a flow of molten metal such that a continuous casting is formed, an aftercooler for receiving the continuous casting from the cooled die and further cooling the continuous casting, the aftercooler comprising: a plurality of aftercooler segments each defining a casting passage therethrough, the aftercooler segments each including, a plurality of aftercooler sections each of the aftercooler sections defining radially angled surfaces which divide the aftercooler segment into cylindrical sectors, a water flow passage and a gas flow passage; a plurality of resilient bands encircling the plurality of aftercooler sections to provide a radially directed force compacting the aftercooler segment and compressing the casting passage; support means for supporting the plurality of aftercooler segments in an end-to-end arrangement such that the casting passages, the water flow passages and the gas flow passages within each of the aftercooler segments are aligned; and a plurality of gas tubes received within the gas flow passages for injecting a flow of inert gas into the casting passage of at least one of the aftercooler segments.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
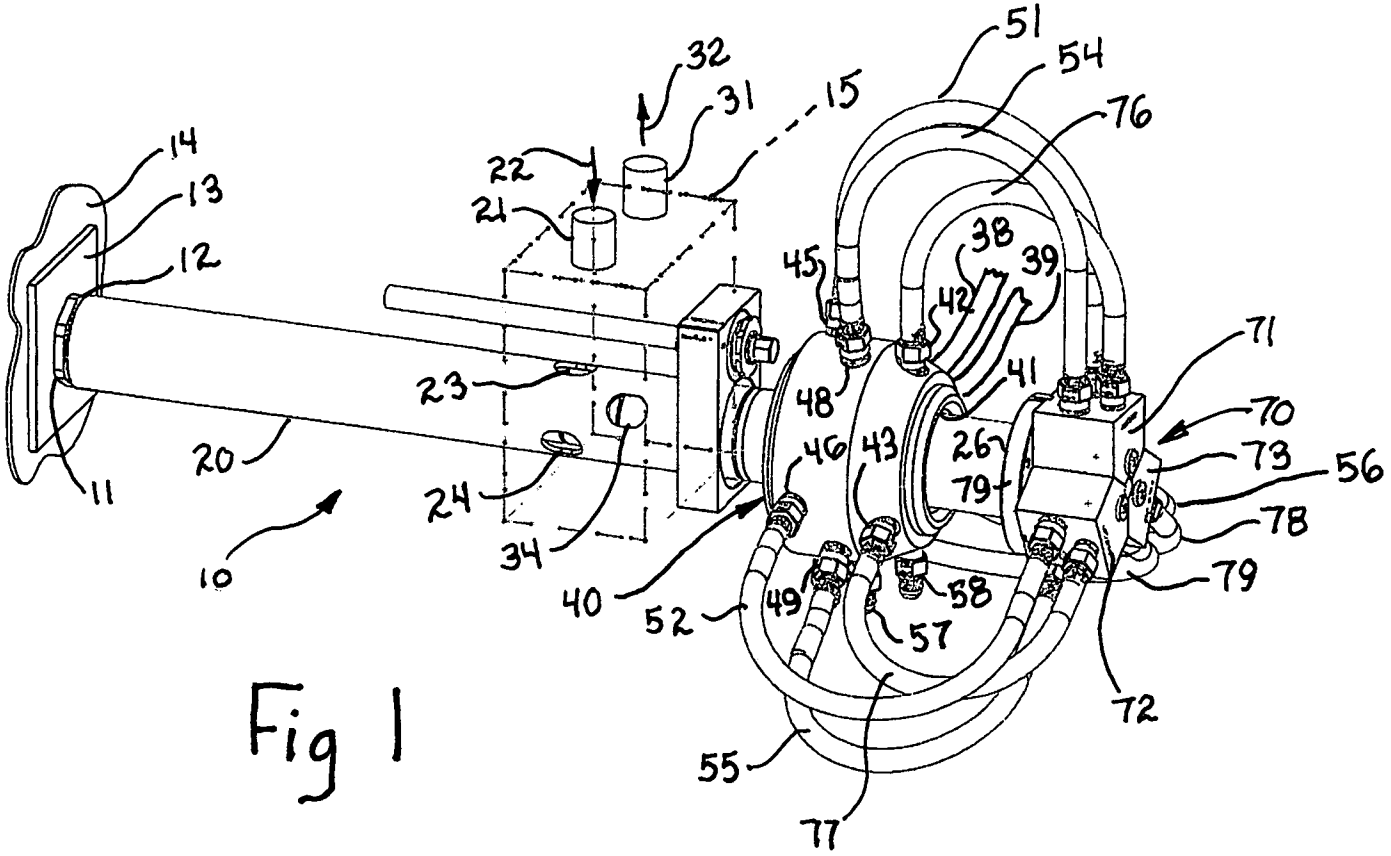
FIG. 1 sets forth a perspective view of a radially acting aftercooler constructed in accordance with the present invention.

FIG. 1 sets forth a perspective view of a radially acting aftercooler constructed in accordance with the present invention and generally referenced by numeral 10. Aftercooler 10 includes an aftercooler barrel 20 supporting a die collar 12 at one end. Aftercooler barrel 20 further supports a mold holder 15 having a water input coupling 21 and a water output coupling 31. Aftercooler barrel 20 defines a plurality of water input apertures 23, 24 and 25 (aperture 25 not seen) together with a plurality of water output apertures 33, 34 and 35 (apertures 33 and 35 not seen).

Radially acting aftercooler 10 further includes an intermediate adapter 40 defining a center passage 41 therethrough. Center passage 41 receives a portion of aftercooler barrel 20 extending through center passage 41 and beyond. Intermediate adapter 40 supports a plurality of gas couplers 42, 43 and 44 (coupler 44 not seen). Intermediate adapter 40 further supports a plurality of aftercooler water input couplers 48, 49 and 50 (coupler 50 not seen) together with a plurality of aftercooler water output couplers 45, 46 and 47 (coupler 47 not seen). Intermediate adapter 40 further includes an aftercooler water input coupler 57 and a water output coupler 58.

The end of aftercooler barrel 20 defines a flange 26 which is joined to a flange 79 thereby supporting an end piece adapter 70. The latter is formed of a trio of adapter sections 71, 72 and 73 which converge and form a casting passage 75 at their mutual junction. Coupler 42 is joined to a gas line 76 which, in turn, is coupled to end piece adapter section 71 by a gas line 76. Similarly, coupler 43 is coupled to end piece adapter section 72 by a gas line 77. In a further similar manner, coupler 44 (not seen) is coupled to end piece adapter section 73 by a gas line 78. A pair of gas lines 38 and 39 supply gas input and output respectively to intermediate adapter 40.

In a typical application of the present invention, aftercooler 10 is utilized in combination with a tundish, or furnace, wall 14. In accordance with conventional fabrication, a nozzle plate 13 supports a nozzle 11 against nozzle collar 12 and a cooled die 19 (seen in FIG. 3). Nozzle 11 extends between cooled die 19 and the molten metal within tundish 14 to provide a flow of molten metal from the interior of tundish 14 through nozzle 11 and into cooled die 19.

In operation, molten metal flows through nozzle 11 and into cooled die 19 (seen in FIG. 3) wherein the metal partially freezes and partially solidifies within cooled die 19 to form a casting, characterized by a solid outer portion and a molten core, which then passes through further cooling passages (seen in FIG. 3) formed within aftercooler 10. The continuous casting thus formed ultimately extends outwardly from end piece adapter 70 through casting passage 75. The extending portion of the continuous casting thus formed is pulled by one, or more, mechanical pullers (not shown) constructed in accordance with conventional fabrication techniques. The pullers withdraw the casting from aftercooler 10 in the above described series of alternating forward and reverse movements forming the above described witness marks upon the casting.

During the time that the casting travels through aftercooler 10, it is subjected to water cooling using a die water cooling system and an aftercooler water cooling system. The two cooling system operate independently. The die water cooling system is constructed in accordance with conventional fabrication techniques and is operative to provide water flow into mold holder 15 via water input 21. This die cooling water flow is carried forward within aftercooler barrel 20 to cooled die 19 in the manner shown in FIG. 3. This die cooling water is applied to water input apertures 23, 24 and 25 through passages formed within mold holder 15

(not shown). Similarly, the return flow from cooled die 19 travels back to mold holder 15 and outwardly from aftercooler barrel 20 through water output apertures 33, 34 and 35. Further passages within mold holder 15 (not shown) direct this flow outwardly through output 31. The cooling of die 19 and the operation of mold holder 15 may be fabricated entirely in accordance with conventional die cooling techniques.

The aftercooler water cooling system operative within the aftercooler water cooling system is constructed in accordance with the present invention and utilizes a combination of a plurality of aftercooler segments each formed of a trio of radially acting aftercooler sections described below. Suffice it to note here that in further accordance with an important aspect of the present invention, a plurality of radially acting aftercooler segments are supported in series connection within aftercooler barrel 20 and are simultaneously provided with flows of cooling water together with a dispersal flow of an inert gas such as argon or the like. A flow of cooling water is supplied to aftercooler 10 through couplers 57 and 58 of intermediate adapter 40. By means set forth below in greater detail, a portion of the aftercooler water flow is directed through the plurality of aftercooler segments (seen in FIG. 3) within aftercooler barrel 20 and a further portion of the aftercooler water flow is directed to end piece adapter 70 by water hoses 51, 52 and 53 together with water hoses 54, 55 and 56.

During the aftercooler operation, and in accordance with an important aspect of the present invention, the radially acting aftercooler sections within each aftercooler segment (described below) converge exerting a force against the outer surface of the casting that constrains the casting against its tendency to assume a crooked shape. The diffusion of inert gas throughout the aftercooler including throughout the casting passages of the aftercooler segments prevents the formation of the above mentioned oxides thereby avoiding oxide plating and degrading of the casting witness marks. The highly efficient cooling provided by the aftercooler structure results in increased cooling efficiency which, in turn, reduces the metallurgical length of the casting.

Figure 2:
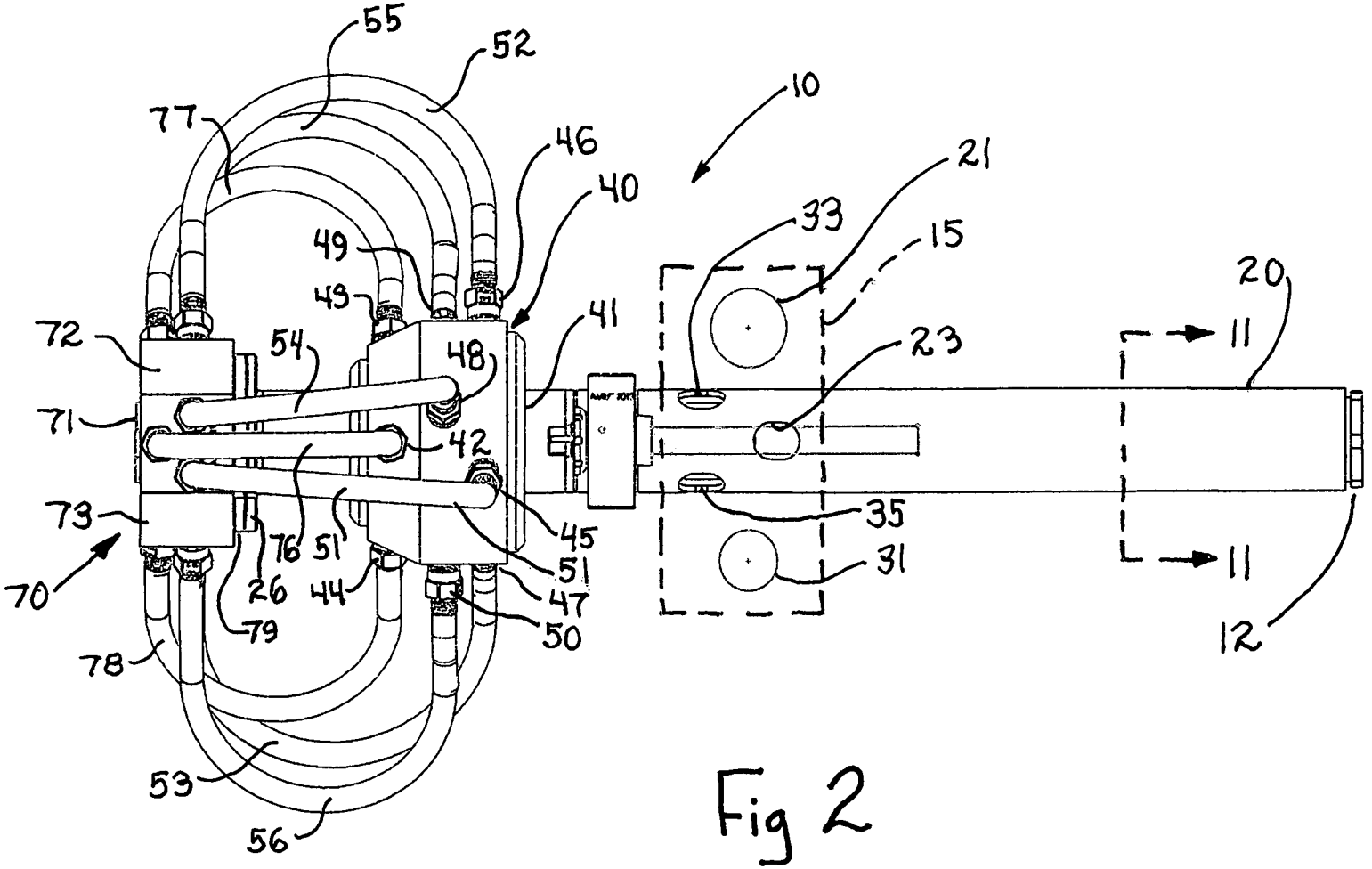
FIG. 2 sets forth a top view of the present invention radially acting after.

FIG. 2 sets forth a top view of aftercooler 10. As described above, aftercooler 10 includes an aftercooler barrel 20 supporting a die collar 12 at one end. Aftercooler barrel 20 further supports a mold holder 15 having a water input coupling 21 and a water output coupling 31. Aftercooler barrel 20 defines a plurality of water input apertures such as aperture 23 together with a plurality of water output apertures such as apertures 33 and 35. Radially acting aftercooler 10 further includes an intermediate adapter 40 defining a center passage 41 therethrough. Center passage 41 receives a portion of aftercooler barrel 20 extending through center passage 41 and beyond. Intermediate adapter 40 supports a plurality of gas couplers 42, 43 and 44. Intermediate adapter 40 further supports a plurality of aftercooler water input couplers 48, 49 and 50 together with a plurality of aftercooler water output couplers 45, 46 and 47. The end of aftercooler barrel 20 defines a flange 26 which is joined to a flange 79 thereby supporting an end piece adapter 70. The latter is formed of a trio of adapter sections 71, 72 and 73 which converge and form a casting passage 75 (seen in FIG. 1) at their mutual junction. Coupler 42 is joined to a gas line 76 which, in turn, is coupled to end piece adapter section 71 by a gas line 76. Similarly, coupler 43 is coupled to end piece adapter section 72 by a gas line 77. In a further similar manner, coupler 44 (not seen) is coupled to end piece adapter section 73 by a gas line 78. A pair of gas lines 38 and 39 supply gas input and output respectively to intermediate adapter 40.

Figure 3:
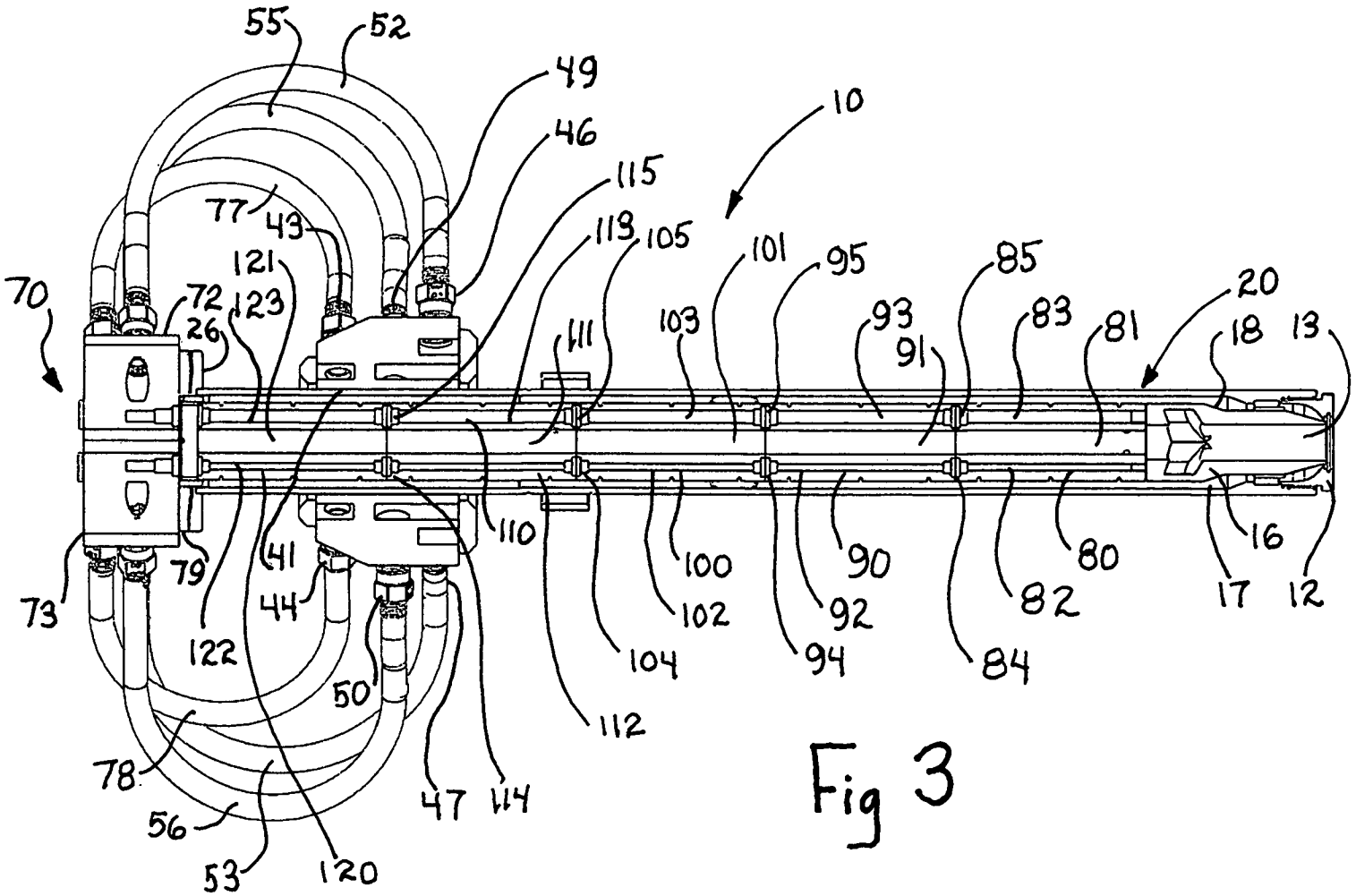
FIG. 3 sets forth a section view of the present invention radially acting aftercooler.

FIG. 3 sets forth a sectioned top view of aftercooler 10 which facilitates examination of the interior of aftercooler barrel 20. As described above, aftercooler 10 includes an aftercooler barrel 20 supporting a die collar 12 at one end. Aftercooler barrel 20 further supports a mold holder 15 which as is set forth above includes a water input coupling 21 and a water output coupling 31. Radially acting aftercooler 10 further includes an intermediate adapter 40 defining a center passage 41 therethrough. Center passage 41 receives a portion of aftercooler barrel 20 extending through center passage 41 and beyond. Intermediate adapter 40 supports a plurality of gas couplers 42 (seen in FIG. 1), 43 and 44. Intermediate adapter 40 further supports a plurality of aftercooler water input couplers 48 (seen in FIG. 1), 49 and 50 together with a plurality of aftercooler water output couplers 45 (seen in FIG. 1), 46 and 47. The end of aftercooler barrel 20 defines a flange 26 which is joined to a flange 79 thereby supporting an end piece adapter 70. The latter is formed of a trio of adapter sections 71 (seen in FIG. 1), 72 and 73 which converge and form a casting passage 75 (seen in FIG. 1) at their mutual junction. Coupler 43 is coupled to end piece adapter section 72 by a gas line 77. Similarly, coupler 44 is coupled to end piece adapter section 73 by a gas line 78. As is better seen in FIG. 1, a pair of gas lines 38 and 39 supply gas input and output respectively to intermediate adapter 40.

Aftercooler barrel 20 supports a die collar 12 within which a cooled die 19 is secured. Die collar 12 is threadably engaged within the inner surface of aftercooler barrel 20 and secures cooled die 19. A water guide 16 is received within aftercooler barrel 20 and is received upon cooled die 19. A plurality of die water cooling passages such as passages 17 and 18 carry water from mold holder 15 to and from die 19 in accordance with conventional fabrication techniques. Water guide 16 aids this water flow by confining the water flow passages near cooled die 19.

In accordance with an important aspect of the present invention, aftercooler 10 further includes a plurality of aftercooler segments 80, 90, 100, 110 and 120 arranged end-to-end within the interior of aftercooler barrel 20 to form a structure extending from the output of cooled die 19 through mold holder 15, intermediate adapter 40, and ending at end piece adapter 70. The structure of aftercooler segments 80, 90, 100, 110 and 120 is set forth below in greater detail. However, suffice it to note here that the end to end configuration of aftercooler segments within aftercooler barrel 20 provided by the aftercooler segments provides several important elements which extend the entire length of the aftercooler segment array. By means described below in greater detail, the aftercooler segments within the aftercooler segment array are maintained in precise alignment by interlocking registration apparatus such that the combined structure provided by the entire aftercooler segment array behaves, in essence, as a single unit.

Accordingly, it will be noted that each aftercooler segment defines a casting passage therethrough. More specifically, aftercooler segments 80, 90, 100, 110 and 120 define respective casting passages 81, 91, 101, 111 and 121. The result is the formation of a casting passage extending from cooled die 19 to end piece adapter 70. Similarly, and as is set forth below in greater detail, each of aftercooler segments 80, 90, 100, 110 and 120 define pluralities of cooling water flow passages therethrough. In the section view of FIG. 3 aftercooler segments 80, 90, 100, 110 and 120 define respective pairs of cooling water passages 82 and 83, 92 and 93, 102 and 103, 112 and 113 as well as 122 and 123. These water flow passages, together with additional water flow passages also defined within the aftercooler segments set forth below, combine to facilitate highly efficient cooling water flow throughout the array of aftercooler segments. To ensure that the water flow passages are protected against leakage, each water flow passage junction between successive aftercooler segments is provided with a sealing coupler. In the cooling water passages shown in FIG. 3 for example, water passage 82 of aftercooler segment 80 is coupled to water passage 92 of coupler 90 by a sealing coupler 84. Similarly, water passage 83 of aftercooler segment 80 is joined to water passage 93 of aftercooler segment 90 by a sealing coupler 85. Correspondingly, sealing coupler 94 joins passages 92 and 102 while sealing coupler 104 joins passages 102 and 112 and further sealing coupler 114 joins passages 112 and 122. In a similar manner, sealing coupler 95 joins passages 93 and 103 while sealing coupler 103 joins passages 103 and 113 and sealing coupler 115 joins passages 113 and 123.

Figure 4:
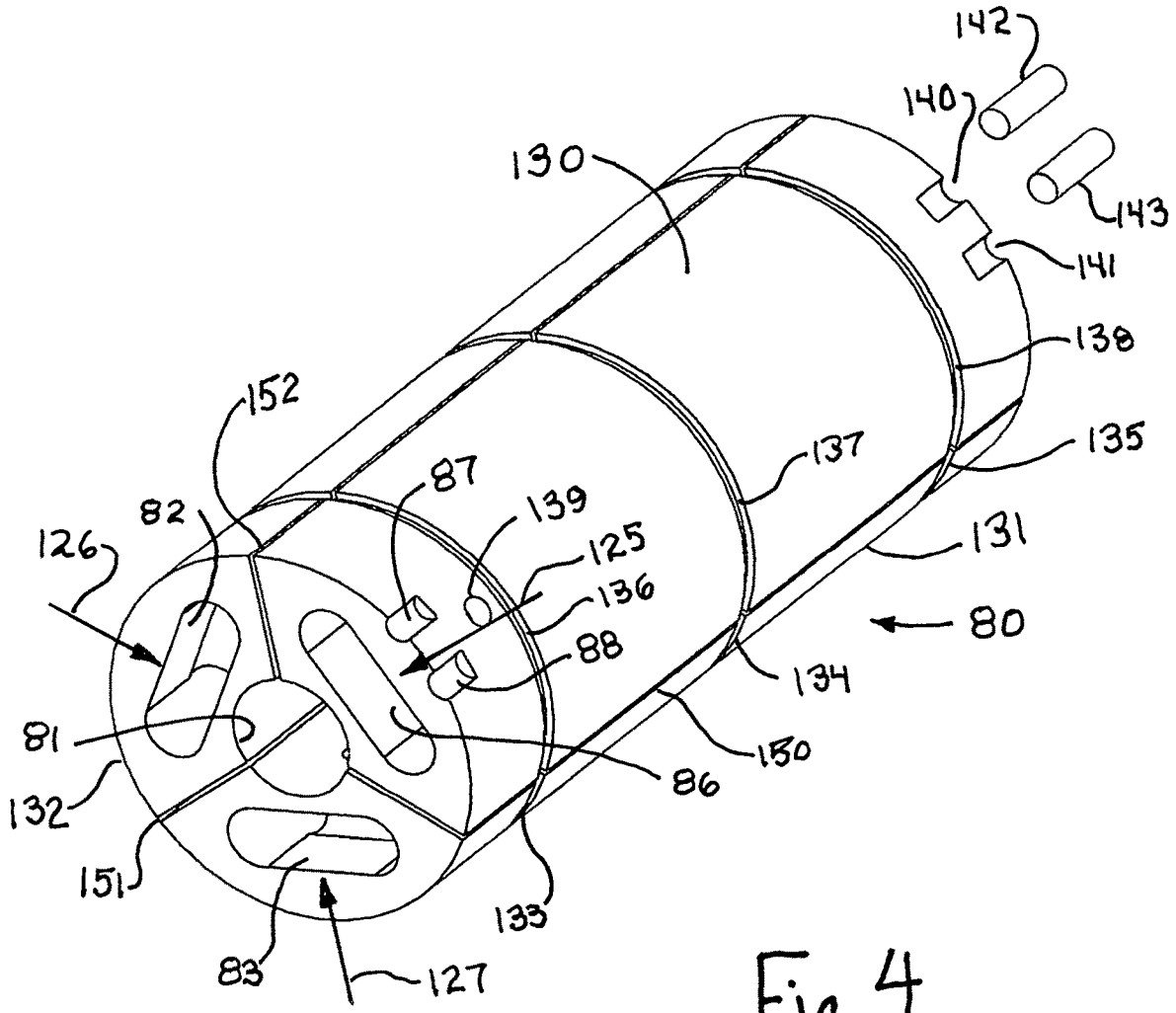
FIG. 4 sets forth a perspective view of an aftercooler segment showing the assembly of three aftercooler sections.

FIG. 4 sets forth a perspective view of aftercooler segment 80 which it will be recalled by temporary return to FIG. 3 is the aftercooler segment which is positioned directly against die 19. It will also be noted by concurrent reference to FIGS. 3 and 7 that aftercooler segment 80, in turn, is directly coupled to aftercooler segment 90 in the above described array of aftercooler segments.

Returning to FIG. 4, it will be noted that aftercooler segment 80 is comprised of a plurality of aftercooler sections 130, 131 and 132 each defining a water cooling passage 86, 83 and 82 respectively. Aftercooler section 130 is also shown defining a gas passage 139. The importance of gas passage 139 is set forth below. Suffice it to note here that each of sections 130, 131 and 132 define a corresponding gas passage. Aftercooler sections 130, 131 and 132 are in essence "wedge shaped" in that they each define angled converging sides which facilitate each section forming a one third cylindrical sector of a cylindrical aftercooler segment. Thus, the combined structure of aftercooler segment 80 formed by cylindrical sector aftercooler sections 130, 131 and 132 is that of a collapsible cylindrical structure.

It will be noted that aftercooler segment 80 is described herein as "collapsible" to communicate an important characteristic of the present invention aftercooler structure. This important characteristic deals with the ability of the aftercooler structure to compensate for wear occurring within casting passage 81 during use. The abrasive character of the casting traveling through casting passage 81 causes abrasion and wear of the casting passage surface. This wear is accommodated and compensated for by the manner in which aftercooler segment 80 is manufactured. At an initial step in the manufacturing process, casting passage 81 is precisely bored to the desired diameter of the casting being manufactured. Thereafter, the aftercooler segment is cut into three aftercooler sections to assume the configuration shown in FIG. 4. During this process, a small amount of metal is removed. Thereafter, when aftercooler segment 80 is assembled in the configuration shown and a starter bar and casting are passed through casting passage 81 to initiate the casting process, a small gap is created between the interfaces of each aftercooler section as the casting exerts an outward force against the surface of casting passage 81. Thus, at the initiation of the casting process, aftercooler segment 80 having a starter bar or casting within casting passage 81 defines a gap 150 between aftercooler sections 130 and 131. Similarly, a gap 151 is defined between aftercooler sections 131 and 132 and a gap 152 is defined between aftercooler sections 132 and 130. The presence of gaps 150, 151 and 152 between the aftercooler sections of aftercooler segment 80 at the initiation of the casting process allows aftercooler segment 80 to compensate for subsequent abrasion and wear within casting passage 81. In essence, as casting passage 81 is worn (and enlarged), gaps 150, 151 and 152 decrease under the urging of resilient O-rings 136, 137 and 138. As a result, the radially acting forces indicated by arrows 125, 126 and 127 are maintained against the casting in order to constrain the casting and prevent it from becoming distorted or crooked as casting passage 81 wears.

In combination, cylindrical sector aftercooler sections 130, 131 and 132 define a casting passage 81 through the center of the cylindrical structure. Aftercooler segment 80 further defines a plurality of grooves 133 134 and 135 which encircle the combined structure of aftercooler sections 130, 131 and 132. In accordance with an important aspect of the present invention, grooves 133, 134 and 135 receive a plurality of resilient elastic bands which in the embodiment shown in FIG. 4 comprise O-rings 136, 137 and 138 respectively. O-rings 136, 137 and 138 are stretched within grooves 133, 134 and 135 to create a compressive elastic force which acts to compact aftercooler sections 130, 131 and 132 to force them radially inwardly in the manner indicated by arrows 125, 126 and 127. This radially directed compressive force acting inwardly to squeeze casting passage 81 is important in the performance of the present invention aftercooler. In its preferred fabrication, aftercooler segment 80 is formed of a metal, such as copper, and is not lined within casting passage 81. Thus, the radially acting compressive forces produced by O-rings 136, 137 and 138 together with the wedge shaped character of aftercooler sections 130, 131 and 132 and the above-mentioned gaps 150, 151 and 152 cooperate to squeeze the surfaces of casting passage 81 directly against a casting therein. This direct constraining force helps to maintain a straight line casting and prevent the crooked casting undulations which have thus far frustrated practitioners in the art.

In order to ensure proper alignment of the plurality of aftercooler segments within the aftercooler barrel (seen in FIG. 3), an alignment structure is provided. A plurality of notches are formed in the aftercooler section surfaces which cooperate with bridging alignment pins to align successive aftercooler segments. For example, aftercooler section 130 of aftercooler segment 80 defines a plurality of notches 87, 88, 140 and 141. A pair of alignment pins 142 and 143 are received within notches 140 and 141 respectively. By way of example with temporary reference to FIG. 9, it will be noted that aftercooler segment 90 defines corresponding notches 145 and 146 which ensures that, when aftercooler segment 90 is properly aligned with afiercooler segment 80, notches 145 and 146 of aftercooler segment 90 will be aligned with notches 140 and 141 respectively. This alignment will allow alignment pin 142 to be received within notches 140 and 145 and will allow pin 143 to be received notches 141 and 146. It will be apparent that a similar alignment mechanism is operative between each section of each abutting aftercooler segment.

Figure 5:
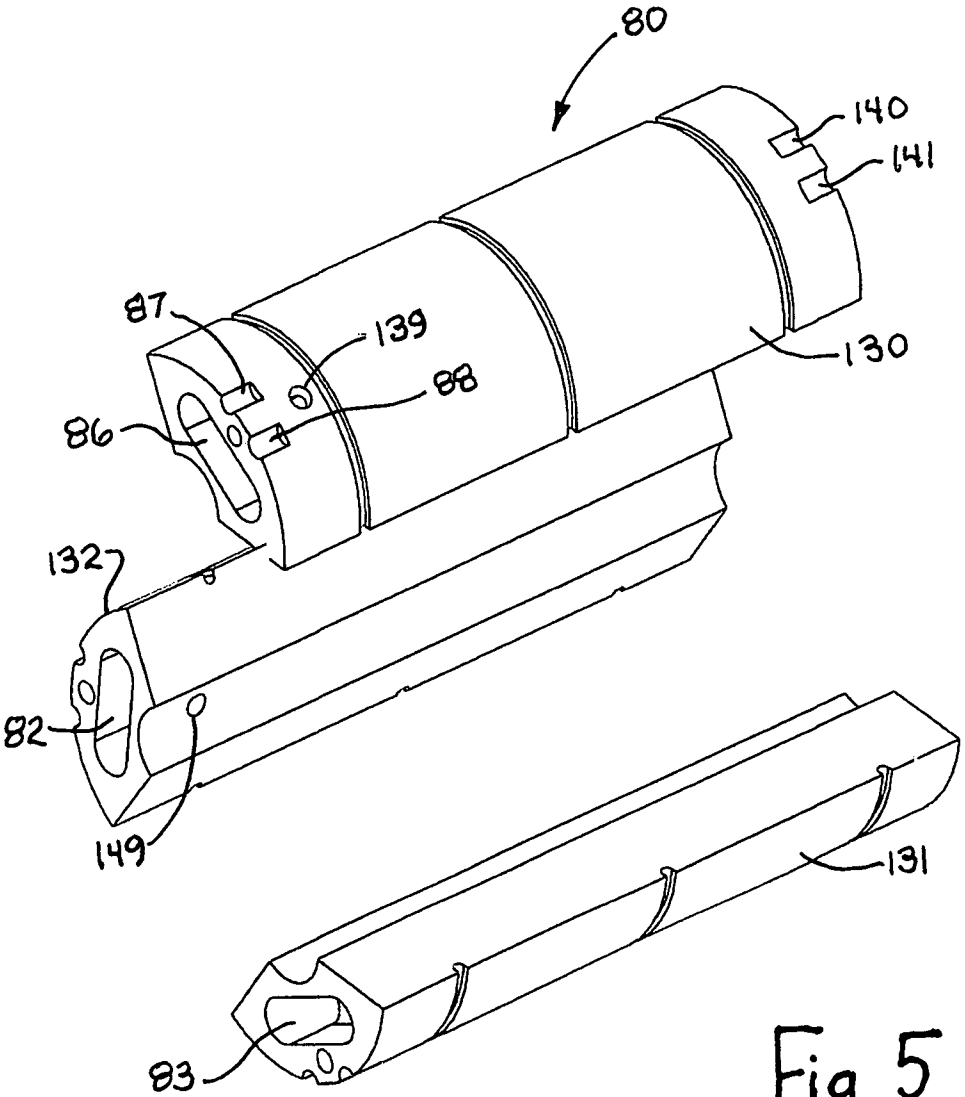
FIG. 5 sets forth a perspective exploded view of the aftercooler segment set forth in FIG. 4.

FIG. 5 sets forth a perspective exploded view of aftercooler segment 80 showing aftercooler segments 130, 131 and 132. As described above, aftercooler segment 80 is formed of aftercooler sections 130, 131 and 132 which are substantially identical and which combine to form the cylindrical structure of aftercooler segment 80. Aftercooler section 130 defines a plurality of alignment notches 87, 88, 140 and 144 together with a water cooling passage 86. Aftercooler section 130 further defines a gas passage 139 which extends through aftercooler section 130 into the casting passage. Similarly, aftercooler section 131 defines a water flow passage 83 and a gas flow passage 148. By further similarity, aftercooler section 132 defines a water flow passage 82 and a gas flow passage 149. Gas flow passage 149 of aftercooler section 132 illustrates the manner in which the respective gas flow passages (139 and 148) of aftercooler sections 130 and 131 enter the casting passage.

Figure 6:
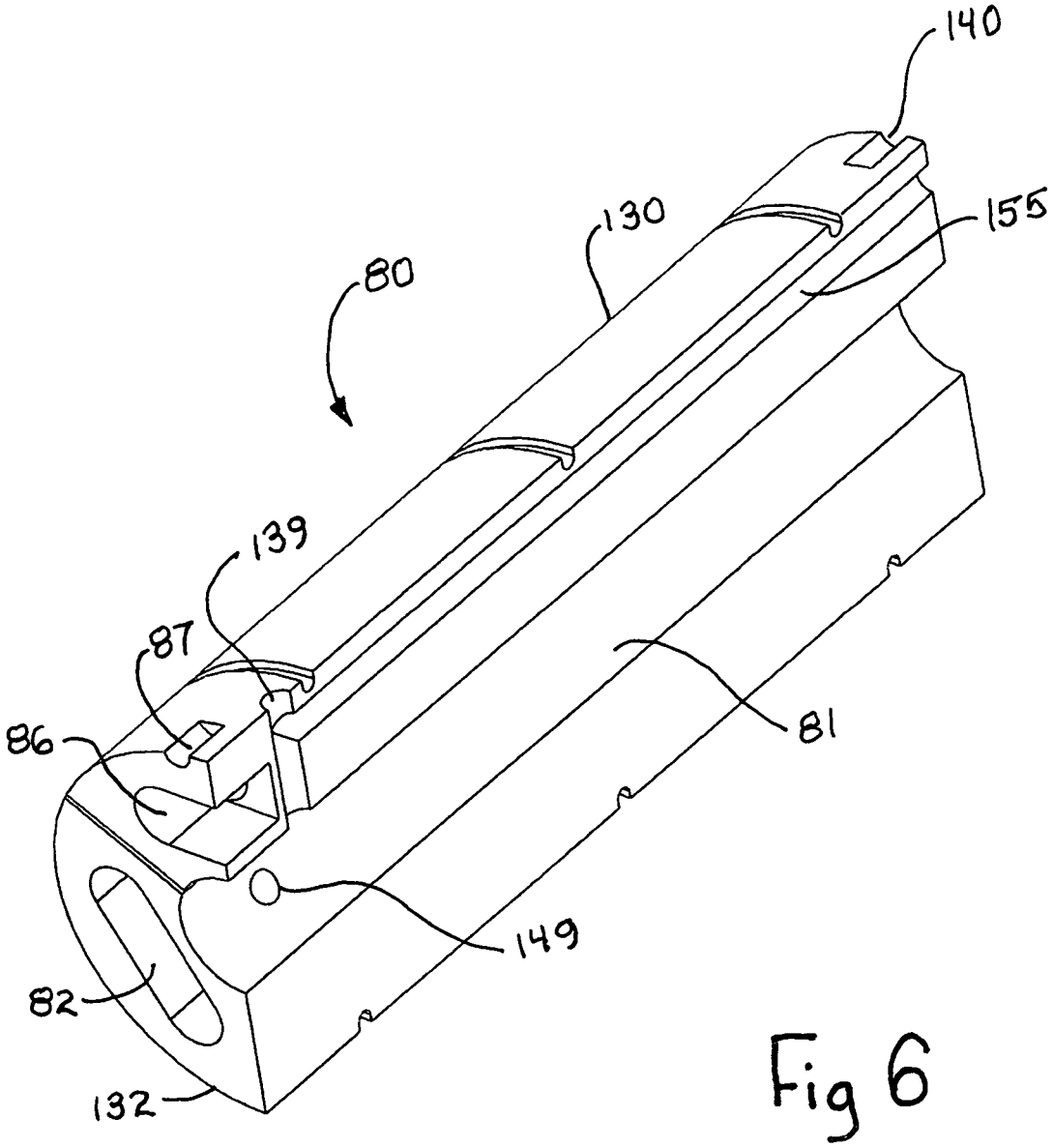
FIG. 6 sets forth a partial section view of the aftercooler segment set forth in FIG. 4.

FIG. 6 sets forth a section view of aftercooler segment 80. As described above, aftercooler segment 80 includes aftercooler sections 130 and 132 which define respective cooling passages 86 and 82. Aftercooler segment 80 further defines a casting passage 81. Aftercooler section 130 defines alignment notches 87 and 140. Aftercooler section 130 defines a length wise gas passage 155 which terminates at a gas passage 139. Gas passage 139 forms a gas transfer passage that extends from the outer surface of aftercooler section 130 to the surface of casting passage 81. Aftercooler section 132 defines a cooling passage 82 and a gas passage 149 which emerges into casting passage 81. Once again, it will be noted that the structure of aftercooler section 130 is repeated within aftercooler sections 131 (seen in FIG. 5) and 132 and thus, each aftercooler section also defines a length wise gas passage which communicates with a inwardly extending gas passage.

Accordingly, while FIG. 6 shows a section view which reveals lengthwise gas passage 155 within aftercooler section 130 of aftercooler segment 80, it will be understood that aftercooler sections 131 and 132 also define corresponding lengthwise gas passages. In addition, as is better seen in FIG. 9 below, it will be further understood that each of the aftercooler sections within each of the aftercooler segments that comprise the aftercooler array also define lengthwise gas passages. In the structure of aftercooler segment 80, which is the first aftercooler segment in the array, the structure shown in FIG. 6 is utilized in which lengthwise gas passage 155 does not pass entirely through aftercooler sections 130, 131 and 132. Once again, with reference to FIG. 9 which shows an example of and intermediate aftercooler segment 90, it will be noted that all other aftercooler segments utilize aftercooler sections having length wise gas passages that extend entirely through the aftercooler section. The use of these gas passages is set forth below in greater detail. However, suffice it to note here that the gas passages facilitate the insertion of gas tubes through the entire array of aftercooler segments in the manner described below.

Figure 7:
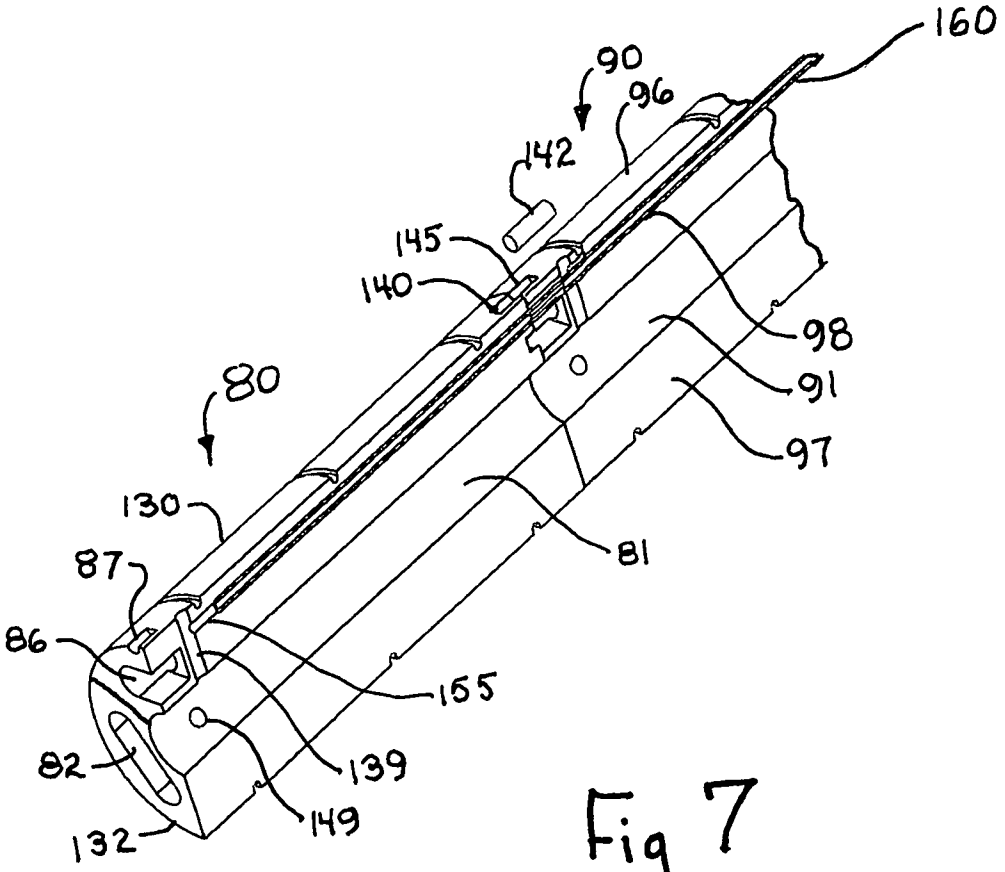
FIG. 7 sets forth a partial section view of a pair of aftercooler segments joined together by a portion of gas line.

FIG. 7 sets forth a sectioned perspective view illustrating the coupling of successive aftercooler segments 80 and 90. It will be understood that this coupling is representative of the successive couplings between the aftercooler segments that are joined end-to-end to form the combined array shown in FIG. 1. As described above, aftercooler segment 80 includes aftercooler sections 130 and 132 which define respective cooling passages 86 and 82. Aftercooler segment 80 further defines a casting passage 81. Aftercooler section 130 defines alignment notches 87 and 140. Aftercooler section 130 defines a length wise gas passage 155 which terminates at a gas passage 139. Gas passage 139 provides a transfer passage for flowing gas from lengthwise gas passage 155 into casting passage 81. Thus, gas passage 139 extends from the outer surface of aftercooler section 130 to the surface of casting passage 81. Aftercooler section 132 defines a cooling passage 82 and a gas passage 149 which emerges into casting passage 81. Once again, it will be noted that the structure of aftercooler section 130 is repeated within aftercooler sections 131 (seen in FIG. 5) and 132 and thus, each aftercooler section also defines a length wise gas passage which communicates with a inwardly extending gas passage.

Aftercooler segment 90 includes aftercooler sections 96 and 97 which form a casting passage 91. Aftercooler section 96 further defines an alignment with notch 145 and a length wise gas passage 98. An alignment pin 142 is received within notches 140 and 145 to ensure proper alignment of aftercooler segments 80 and 90. Of importance to note in FIG. 7 is the alignment of lengthwise gas passage 98 of aftercooler section 96 and lengthwise gas passage 155 of aftercoolers section 130. This alignment facilitates the insertion of gas tube 160 which, as is described below, is carried forward through each aftercooler section of each aftercooler segment to complete the aftercooler segment array of the present invention.

Figure 8:
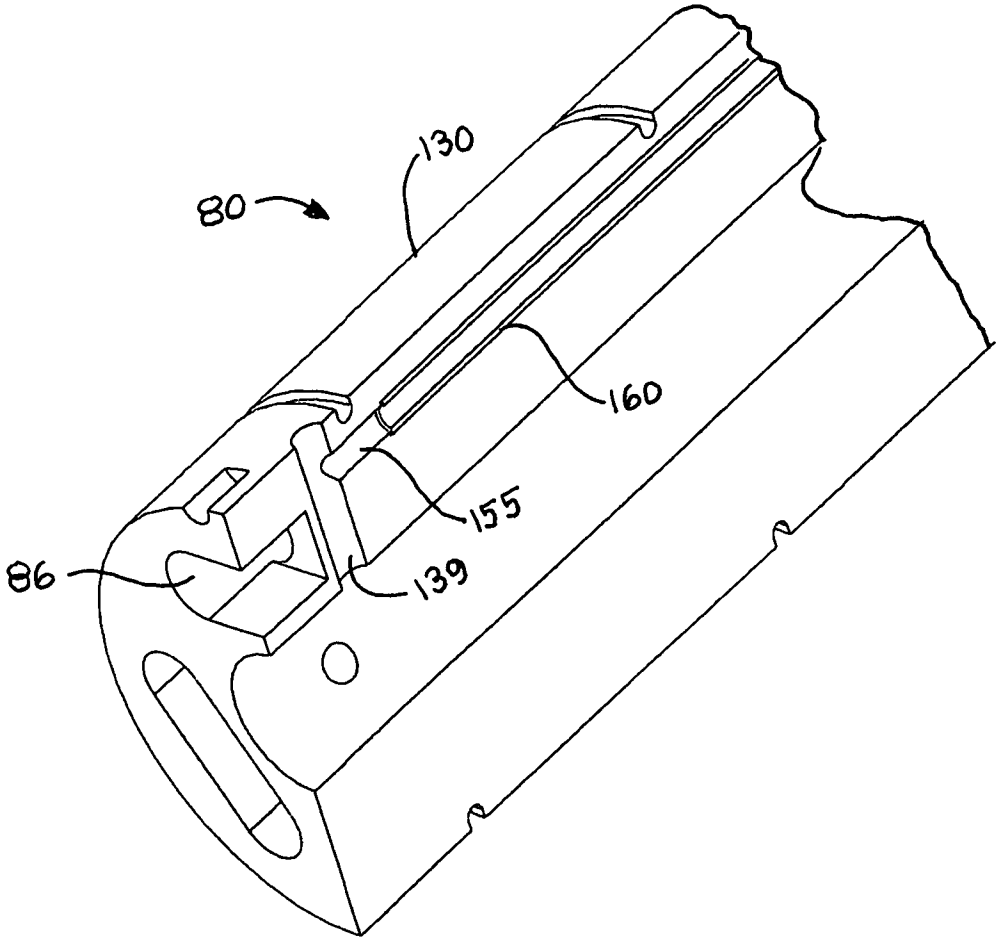
FIG. 8 sets forth an enlarged partial section view of the gas line support within the aftercooler segment shown in FIG. 7.

FIG. 8 sets forth an enlarged view of the frontal portion of aftercooler section 130 of aftercooler segment 80. Of importance to note in FIG. 8 is the structure of lengthwise passage 155 intersecting gas passage 139. Also, it should be noted that gas tube 160 is positioned short of entering gas passage 139.

Figure 9:
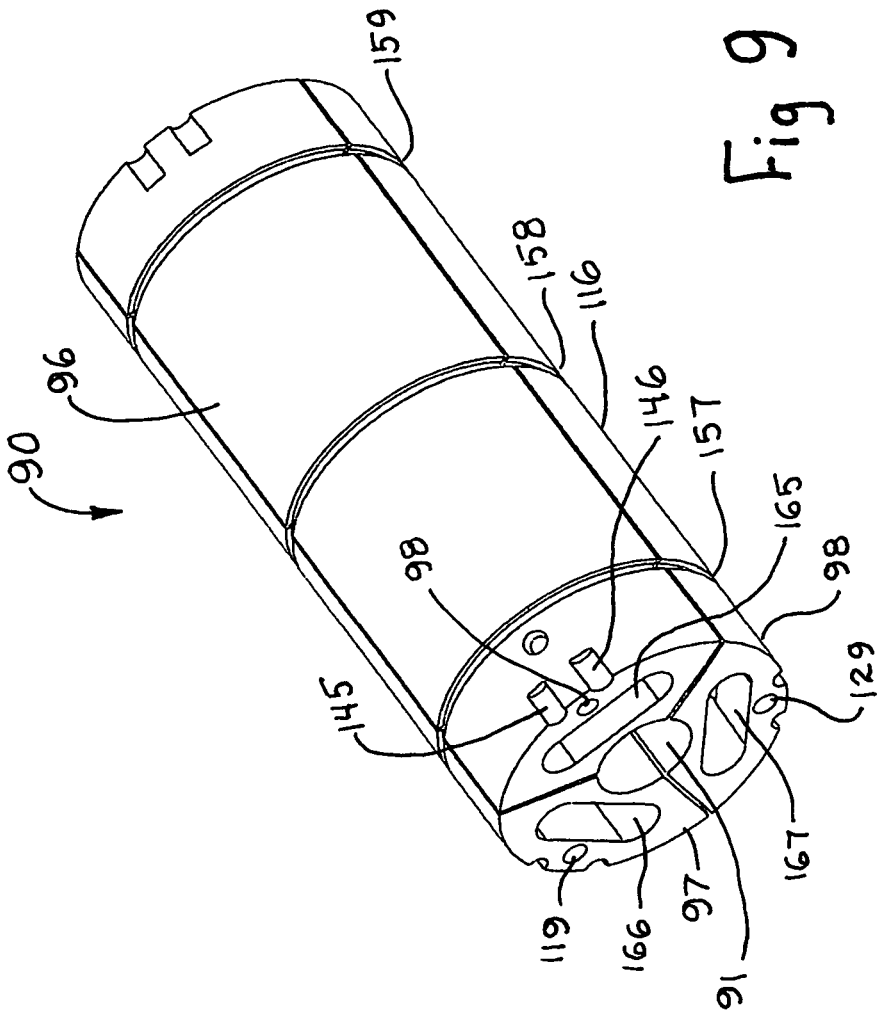
FIG. 9 sets forth a perspective view of an intermediate aftercooler segment.

FIG. 9 sets forth a perspective view of aftercooler segment 90 which is set forth as an example of an aftercooler segment that is "intermediate" within the array of aftercooler segments. Accordingly, it will be apparent to those skilled in the art that the descriptions of aftercooler segment 80 apart from the structure of the length wise gas passages in each section apply equally well to, and are equally descriptive of, aftercooler segment 90 and the remaining intermediate aftercooler segments. The difference found between aftercooler segment 80 and the remaining aftercooler segments within the array (aftercooler segments 90, 100, 110 and 120) is limited to the provision of lengthwise gas passages extending entirely through each aftercooler section of the aftercooler segments.

More specifically, aftercooler segment 90 includes cylindrical sector are aftercooler sections 96, 97 and 116 which combine to form the cylindrical structure described above. The cylindrical sector aftercooler sections of aftercooler segment 90 are secured by a plurality of O-rings 157, 158 and 159 supported within a corresponding grooves in the same manner as described above for aftercooler segment 80. Aftercooler section 96 defines a length wise gas passage 98 extending through the entire aftercooler section. Similarly, aftercooler sections 97 and 116 define respective lengthwise gas passages 119 and 129 also extending entirely through the aftercooler sections. The extension of lengthwise gas passages through each of the aftercooler sections facilitates the insertion of gas tubes through the aftercooler segment array in the manner described below.

Figure 10:
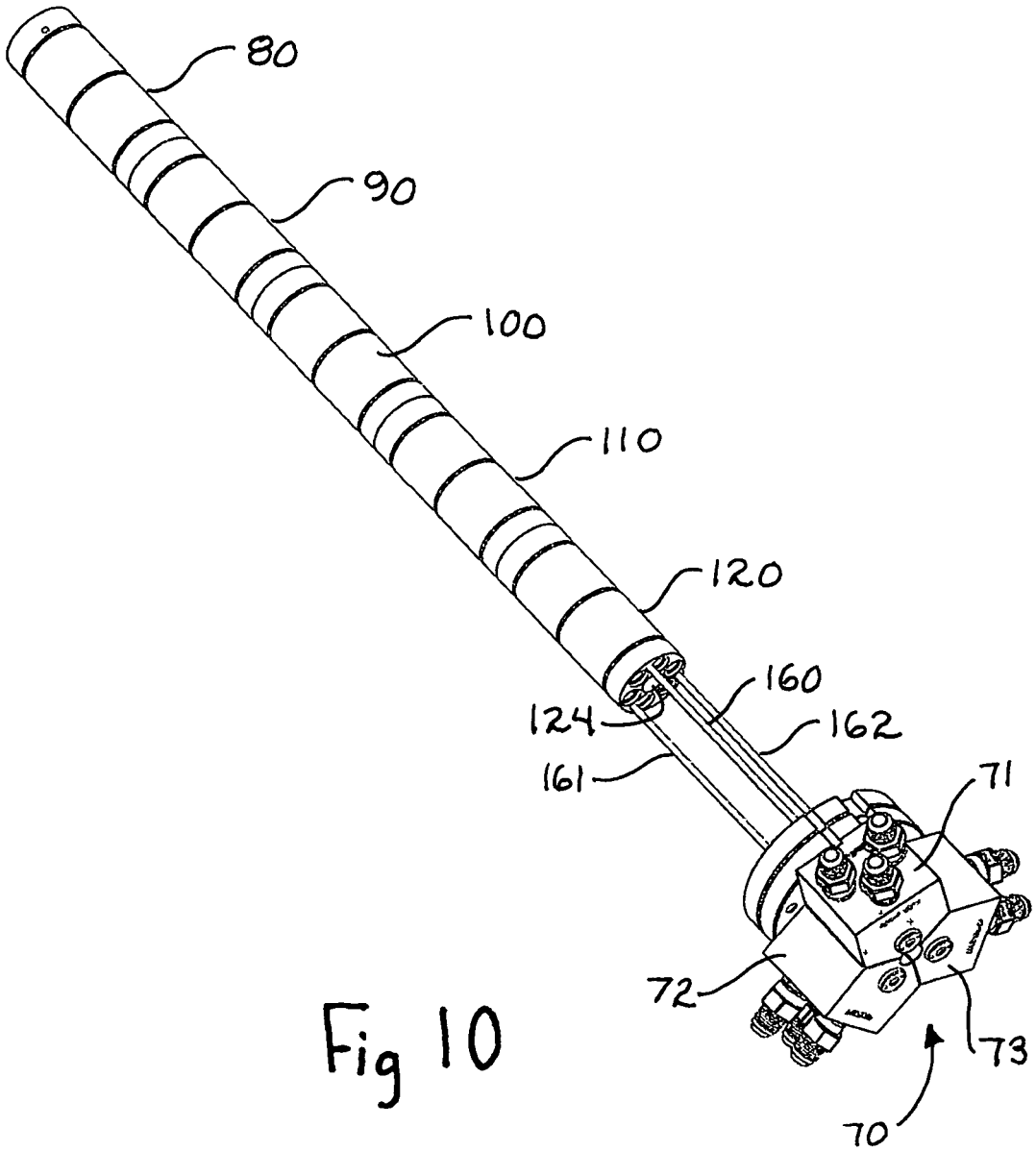
FIG. 10 sets forth a partial perspective view of the end piece adapter of the present invention radially acting aftercooler showing the insertion of three gas lines.

FIG. 10 sets forth a perspective view of end piece adapter 70 having a plurality of gas tubes 160, 161 and 162 extending therefrom. FIG. 10 also shows aftercooler segments 80, 90, 100, 110 and 120 arranged in the end-to-end array described above. It will be recalled that end piece adapter 70 includes adapter sections 71, 72 and 73. It will be further recalled that adapter sections 71, 72 and 73 are each supplied with a flow of inert gas, such as argon, through a corresponding plurality of gas tubes 76, 77 and 78 from adapter 40 (seen in FIG. 1). As is also described above, aftercooler segments 100, 110 and 120 are identical in fabrication to aftercooler segment 90 set forth in FIG. 9 above. Thus, as is shown in FIG. 9 aftercooler segment 90 defines lengthwise gas passages 98, 119 and 129 which extend through aftercooler 90. In a similar manner, aftercooler segments 100, 110 and 120 also defined respective lengthwise gas passages which extend through each aftercooler segment. As is set forth above in FIG. 6, aftercooler segment 80 which abuts cooled die 19 (seen in FIG. 3) defines a plurality of length wise gas passages which do not extend entirely through the aftercooler segment but rather communicate with transfer passages that direct the gas flow into casting passage 81. This inert gas flow travels through the casting passages of aftercooler segments 80, 90, 100, 110 and 120 and dissipates outwardly through casting passage 124 of aftercooler segment 120. Additional inert gas is dispersed throughout the interior of aftercooler barrel 20 (seen in FIG. 1) to provide an inert gas environment throughout the aftercooler which prevents oxidation of the casting.

Figure 11:
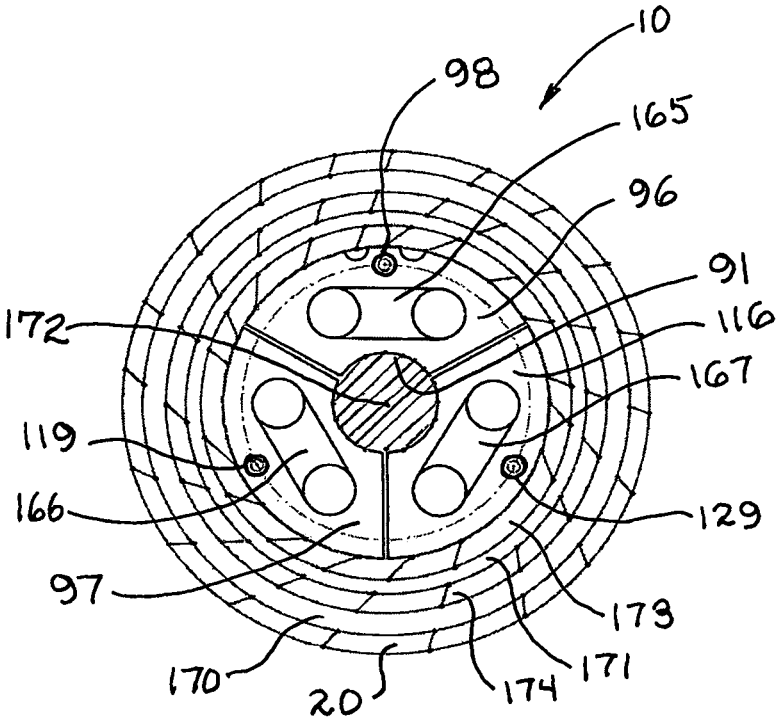
FIG. 11 sets forth a section view of the present invention radially acting aftercooler taken along section lines 11-11 in FIG. 2.

FIG. 11 sets forth a section view of radially acting aftercooler 10 taken along section lines 11-11 in FIG. 2. Aftercooler 10 includes a generally cylindrical aftercooler barrel 20 within which a generally concentric water guide 174 is supported. A water passage 170 is formed between the interior surface of aftercooler barrel 20 and the outer surface of water guide 174 which provides a cooling water flow to cooled die 19 (seen in FIG. 3). Within the interior of water guide 174 a return water flow path 171 is also provided which returns cooling water flow from cooled die 19 (seen in FIG. 3). It will be recalled that the water flow provided to cooled die 19 and returning from cooled die 19 is produced by mold holder 15 (seen in FIG. 1). Aftercooler barrel 20 further supports an aftercooler tube 173 within which a plurality of aftercooler segments such as aftercooler segment 90 are supported. Aftercooler segment 90 is typical of the remaining aftercooler segments within aftercooler barrel 20 and includes a trio of aftercooler sections 96, 97 and 116. It will be recalled that aftercooler sections 96, 97 and 116 are generally wedge shaped defining tapered sides which facilitate the radially inward compression of aftercooler segment 90 in the manner described above in FIG. 9. Suffice it to note here that this inward compressive force upon aftercooler sections 96, 97 and 116 forms a constrained casting passage 91 at the center of aftercooler segment 90. Within casting passage 91, a casting 172 is captivated. It will be noted that aftercooler segment 90 does not utilize a casting passage liner of any type. Instead, aftercooler segment 90 utilizes an inert gas flow, described above, which is dispersed within casting passage 91 to aid the movement of casting 172 through the aftercooler. Aftercooler sections 96, 97 and 116 define water cooling passages 165, 166 and 167 respectively. In addition, aftercooler sections 96, 97 and 116 also define gas passages 98, 119 and 129 respectively each of which receives a gas tube such as gas tube 160 shown in FIG. 7 when aftercooler 10 is assembled.

What has been shown is an improved aftercooler that avoids the need for lubricating graphite within the aftercooler passage and which increases cooling efficiency and wear resistance. The improved aftercooler maintains a straight casting while producing a casting substantially reduced in the creation of voids and shrinkage pockets. The improved aftercooler shown cools the casting exiting the aftercooler to a reduced temperature thereby avoiding the formation of oxides and degraded witness marks on the casting.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in a horizontal continuous casting system in which a cooled die is supplied with a flow of molten metal such that a continuous casting is formed, an aftercooler for receiving the continuous casting from the cooled die and further cooling the continuous casting, said aftercooler comprising:

a plurality of aftercooler segments each defining a casting passage therethrough, said aftercooler segments each including, a plurality of aftercooler sections each of said aftercooler sections defining radially angled surfaces which divide said aftercooler segment into cylindrical sectors, a water flow passage and a gas flow passage;

a plurality of bands encircling said plurality of aftercooler sections to provide radially directed forces compacting said aftercooler segment and compressing said casting passage;

support means for supporting said plurality of aftercooler segments in an end-to-end arrangement such that said casting passages, said water flow passages and said gas flow passages within each of said aftercooler segments are aligned; and a plurality of gas tubes received within said gas flow passages for injecting a flow of inert gas into said casting passage of at least one of said aftercooler segments.

2. The aftercooler set forth in claim 1 wherein said aftercooler segments are cylindrical and wherein said aftercooler sections define cylindrical sectors.

3. The aftercooler set forth in claim 2 wherein said aftercooler sections each define a plurality of external grooves and wherein said plurality of bands includes a plurality of O-rings received within said external grooves in a stretched condition.

4. The aftercooler set forth in claim 3 wherein said support means includes a generally cylindrical aftercooler barrel defining an interior passage within which said aftercooler segments are arranged in said end-to-end arrangement.

5. The aftercooler set forth in claim 4 wherein said support means further includes an elongated cylindrical aftercooler tube supported within said aftercooler barrel and wherein said plurality of aftercooler segments are arranged in said end-to-end arrangement within said aftercooler tube.

6. The aftercooler set forth in claim 5 wherein each of said aftercooler sections defines a cylindrical outer surface and opposed ends and wherein said support means includes pluralities of alignment notches formed in said outer surfaces of said aftercooler sections at said opposed ends and pluralities of bridging pins received within said alignment notches.

7. For use in a horizontal continuous casting system an aftercooler for receiving a continuous casting from a cooled die, said aftercooler comprising:

a plurality of cylindrical aftercooler segments, each defining a casting passage, a plurality of water flow passages and a plurality of gas flow passages therethrough, arranged in an end-to-end array such that said casting passages, said water flow passages and said gas flow passages of said aftercooler segments are aligned; and a plurality of gas tubes received within said gas flow passages for injecting a flow of inert gas into said casting passage of at least one of said aftercooler segments.

8. The aftercooler set forth in claim 7 wherein said aftercooler segments each include:

a plurality of aftercooler sections each of said aftercooler sections defining radially angled surfaces which divide said aftercooler segment into cylindrical sectors; and a plurality of bands encircling said plurality of aftercooler sections to provide radially directed forces compacting said aftercooler segment and compressing said casting passage.

9. The aftercooler set forth in claim 8 wherein said aftercooler sections each define a plurality of external grooves and wherein said plurality of bands includes a plurality of O-rings received within said external grooves in a stretched condition.

* * * * *